US011320189B1

(12) United States Patent
Tippmann et al.

(10) Patent No.: US 11,320,189 B1
(45) Date of Patent: May 3, 2022

(54) QUICK FREEZE PALLET RACKS WITH VARIABLE LOUVERED DOORS

(71) Applicant: Tippmann Construction, LLC, Fort Wayne, IN (US)

(72) Inventors: Joshua T. Tippmann, Fort Wayne, IN (US); Brandon L. Wellman, Fort Wayne, IN (US); Caleb P. Herber, Fort Wayne, IN (US)

(73) Assignee: Tippmann Construction, LLC, Fort Wayne, IN (US)

( * ) Notice: Subject to any disclaimer, the term of this patent is extended or adjusted under 35 U.S.C. 154(b) by 0 days.

(21) Appl. No.: 17/322,972

(22) Filed: May 18, 2021

Related U.S. Application Data

(63) Continuation of application No. PCT/US2020/059976, filed on Nov. 11, 2020.

(51) Int. Cl.

| | |
|---|---|
| ***F25D 17/00*** | (2006.01) |
| ***F24F 13/15*** | (2006.01) |
| ***F25D 17/06*** | (2006.01) |
| ***F25D 17/04*** | (2006.01) |
| ***F24F 13/14*** | (2006.01) |
| ***F24F 13/16*** | (2006.01) |
| ***F16K 1/16*** | (2006.01) |

(52) U.S. Cl.
CPC ..... *F25D 17/06* (2013.01); *F16K 1/165* (2013.01); *F24F 13/14* (2013.01); *F24F 13/1413* (2013.01); *F24F 13/1426* (2013.01); *F24F 13/15* (2013.01); *F24F 13/16* (2013.01); *F25D 17/005* (2013.01); *F25D 17/045* (2013.01)

(58) Field of Classification Search
CPC ..... F16K 1/165; F24F 13/1413; F24F 13/15; F25D 17/06; F25D 17/045; E06B 7/084
See application file for complete search history.

(56) References Cited

U.S. PATENT DOCUMENTS

| | | | | |
|---|---|---|---|---|
| 2,216,413 A | | 10/1942 | Jones | |
| 2,623,251 A | * | 12/1952 | Tocchetto | E06B 7/084 49/74.1 |
| 4,339,928 A | | 7/1982 | Guibert | |

(Continued)

FOREIGN PATENT DOCUMENTS

| | | |
|---|---|---|
| CN | 201436526 U | 4/2010 |
| JP | 2007-285608 A | 11/2007 |

OTHER PUBLICATIONS

English translation of CN 201436526 U (machine translation obtained from Google Patents—patents.google.com on Sep. 2, 2021).

(Continued)

*Primary Examiner* — Steven S Anderson, II
*Assistant Examiner* — Phillip Decker
(74) *Attorney, Agent, or Firm* — Woodard, Emhardt, Henry, Reeves & Wagner, LLP

(57) ABSTRACT

Pallet racking systems are designed to quickly freeze items using thermal transfer by moving air through palletized products. Air is pulled through the palletized product to a negative air plenum behind the pallet rack. Back panels of the pallet racks provide variable-height airflow by use of louvers which are individually pressed open by the palletized product to accommodate differing product heights. The panels allow more efficient system operation with any number of rack positions filled.

18 Claims, 15 Drawing Sheets

(56) References Cited

U.S. PATENT DOCUMENTS

| | | | | |
|---|---|---|---|---|
| 5,363,670 | A | 11/1994 | Bartilucci | |
| 5,524,451 | A | 6/1996 | Tippmann | |
| 5,915,960 | A * | 6/1999 | Check | F24H 3/0488 432/222 |
| 6,340,043 | B1 | 1/2002 | Paupardin | |
| 6,901,768 | B1 | 6/2005 | Windecker | |
| 7,017,366 | B2 | 3/2006 | Bottom | |
| 8,220,287 | B2 | 7/2012 | Tippmann et al. | |
| 8,783,047 | B2 | 7/2014 | Tippmann | |
| 8,919,142 | B2 | 12/2014 | Tippmann | |
| 9,533,828 | B1 | 1/2017 | Dwarakananth et al. | |
| 9,664,409 | B2 * | 5/2017 | Marak | F24F 11/72 |
| 9,873,547 | B2 | 1/2018 | Tippmann | |
| 10,194,682 | B2 | 2/2019 | Tippmann | |
| 10,202,240 | B2 | 2/2019 | De Angelis et al. | |
| 10,368,466 | B1 * | 7/2019 | Frink | H05K 7/20145 |
| 10,375,978 | B2 | 8/2019 | Woolf et al. | |
| 10,704,821 | B2 | 7/2020 | Sigety et al. | |
| 10,801,765 | B2 * | 10/2020 | Hung | F24F 11/46 |
| 10,807,764 | B2 | 10/2020 | Tippmann | |
| 10,863,759 | B2 | 12/2020 | Tippmann | |
| 2011/0107784 | A1 | 5/2011 | Tippmann et al. | |
| 2013/0055748 | A1 | 3/2013 | Mahajan | |
| 2019/0037728 | A1 | 1/2019 | Roy | |
| 2019/0274336 | A1 * | 9/2019 | Tippmann | F25D 17/045 |

OTHER PUBLICATIONS

English translation of JP 2007-285608 A (machine translation obtained from Google Patents—patents.google.com on Sep. 1, 2021).

Search Report and Written Opinion in International Application No. PCT/US2020/059976, dated Aug. 11, 2021, 9 pages.

* cited by examiner

QUICK FREEZE PALLET RACKS WITH VARIABLE LOUVERED DOORS

CROSS-REFERENCE TO RELATED APPLICATION

This application is a continuation of International Patent Application No. PCT/US2020/059976, filed Nov. 11, 2020, entitled "Quick Freeze Pallet Racks With Variable Louvered Doors", which is hereby incorporated by reference.

BACKGROUND

Blast freezing is a known process for quickly exposing food products to air chilled to very low temperatures (e.g., −40° F./−40° C.) for a period of time sufficient to completely freeze the food products. FIG. 1 illustrates an example of a palletized product 10 suitable for blast freezing. Palletized product 10 includes a pallet 11 supporting a stacked arrangement of a plurality of food product containers 12 with spacers 13 between rows of containers 12. Such spacers are known in the art for allowing the passage of freezing air between the layers of food product containers. Alternatively or concurrently, the food product containers 12 may have openings in their sides to allow for air flow directly through the containers. In an example conventional blast freezing facility (not shown), a dedicated blast freezing room includes a pallet rack for seating multiple palletized products 10. Pallet rack includes pallet seats arranged in columns, rows, and layers. For example, pallet rack may include four (4) columns and four (4) rows with each row having a depth covering five (5) pallet seats. Thus, at max capacity, such a pallet rack could seat eighty (80) palletized products 20.

In operation, blast freezing room is maintained at approximately −40° F./−40° C. and air handling equipment (typically in the form of fans atop the pallet rack) is activated to direct a flow 15 of freezing air through the palletized products 10 at a specified flow rate to quickly freeze the palletized products 10. Ideally, the freezing air uniformly flows through spacers 13 to equally freeze the palletized products 10 within approximately the same amount of time. However, much of the freezing air follows flow paths 17 around and between the palletized products 10 where there is less resistance than flowing through the palletized product 10. Less freezing air than desired follows flow paths through spacers 13, where flow paths 15 are in closer contact with the food to be frozen. The limitation in flow through paths is the natural result of flow paths 17 having less resistance to air flow than flow paths 15. Furthermore, the freezing air flowing through the pallets in flow paths 15 can pass through consecutive pallets and be sequentially warmed by each pallet, so as to make the cooling of the pallets on the exit side slower than those on the entrance side.

Additionally, the flow rate through the series of multiple consecutive pallets tends to have drag. The result is an increase in the amount of time required to adequately freeze all of the palletized products 10, accompanied by the use of colder temperatures from a separate freezing system dedicated to the blast freezing process.

U.S. Patent Application Publication No. 2006/0185528 to Gerald Tippmann et al. discloses an array of palletized products in a warehouse that have a dedicated fan to bring freezing warehouse air rapidly through the palletized products with only a single pallet thickness for the air path without having a dedicated refrigeration system associated with the air handler. U.S. Pat. No. 3,621,672 to Meredith discloses a blast cooling system that uses racks with seals around pathways from an air plenum to force cooling, non-freezing air through palletized food products in a refrigerated warehouse. Meredith discloses that the air flow can be in either direction as may be desired. Along similar lines, U.S. Pat. No. 7,017,366 to Bottom discloses both vertical and horizontal flexible seal elements to engage the palletized product to direct cooling, non-freezing air through palletized product, rather than around it. U.S. Pat. No. 6,340,043 to Paupardin discloses flexible seals for the sides of palletized products in a tunnel arrangement. U.S. Patent Application Publication No. 2011/0107784A1 to Tippmann et al. discloses blast freezing systems with panels that are adjusted by inserting pins at discrete heights to adjust panel opening to accommodate pallets of different heights. However, such systems are labor-intensive, requiring manual adjustment of each of the panels in each rack position. When considered in relation to the variety of shapes and sizes of palletized products and the fact that freezing warehouses may have hundreds of rack positions, the burden of manually adjusting the panels is substantial and renders large-scale deployments of such systems impractical.

Accordingly, there is a need for pallet rack systems with airflow panels which adjust automatically to the height of the palletized goods which are to be subjected to temperature adjustments through thermal transfer of airflow.

SUMMARY

The present disclosure provides for rack systems with airflow openings which are automatically adjusted to open to different heights corresponding to the different heights of various palletized goods placed in the rack for freezing, cooling, or other thermal adjustments. These variable-sized openings increase airflow through the palletized goods, rather than around the edges of the pallet where there would be less resistance, increasing the rate at which the temperature of the goods can be adjusted, which benefits overall system efficiency. Heat transfer may be improved by decreasing turbulence around the pallet. Such improvements may provide various benefits, such as reducing the differential between the product goal temperature and the controlled environmental temperature, reducing capital and utility costs, and improving working conditions for equipment operators. An additional advantage over prior art systems is the fact that the system can be operated when the rack is at any capacity, as the louvered doors automatically seal unfilled rack positions from airflow, thereby preventing wasted resources on cooling (or heating) an empty space. This advantage also avoids manual labor and/or complicated engineering required to reconfigure rack openings when inventory needs require using fewer than all rack positions. Such rack systems may include additional side sealing elements to further increase system efficiencies.

In one embodiment, the disclosure provides a door panel for use in pallet rack assemblies that has a series of louvers mated with a frame, such that the louvers are pivotable to open and close independently to permit airflow through the panel at a variety of different height positions. The louvers may include lever arms which tilt the louvers to the closed position in the absence of pressure from a pallet of goods seated on the rack and against the panel. When palletized goods are placed against the louvers, the lever arms in contact with the goods are pushed to rotate the louvers into the open position, thereby directing airflow through the palletized goods. Preferably, such panels are used in conjunction with a sealed plenum in a single depth pallet rack. Optionally, such louvers (or a portion of such louvers) can be configured such that a certain amount of negative air pressure in the plenum will open the louver, providing an overpressure relief device to prevent the air handling equipment from excess strain.

The disclosure includes pallet racks containing an array of pallet seats adjacent to a plenum, wherein a frame between a pallet seat and the plenum includes a pivoting louver to selectively open the pallet seat to airflow when a pallet is placed in a given seat. Flexible side sheets oriented substantially perpendicular to the frame are deformable upon introduction of airflow to press against the sides of the palletized product, thereby sealing the sides of palletized product from excess airflow and directing more air through the product. In some embodiments, the frame includes uprights with sawtooth openings to receive the louvers, providing easy access for tool-less installation, removal, or replacement of the louvers.

The disclosure includes thermal processing facilities including the above items in combination with pallet rack assemblies, air handling equipment (e.g., fans), evaporators, condensers, heaters, plenums, and seals, with a preferred application being blast freezing systems.

DETAILED DESCRIPTION

Figure 1:
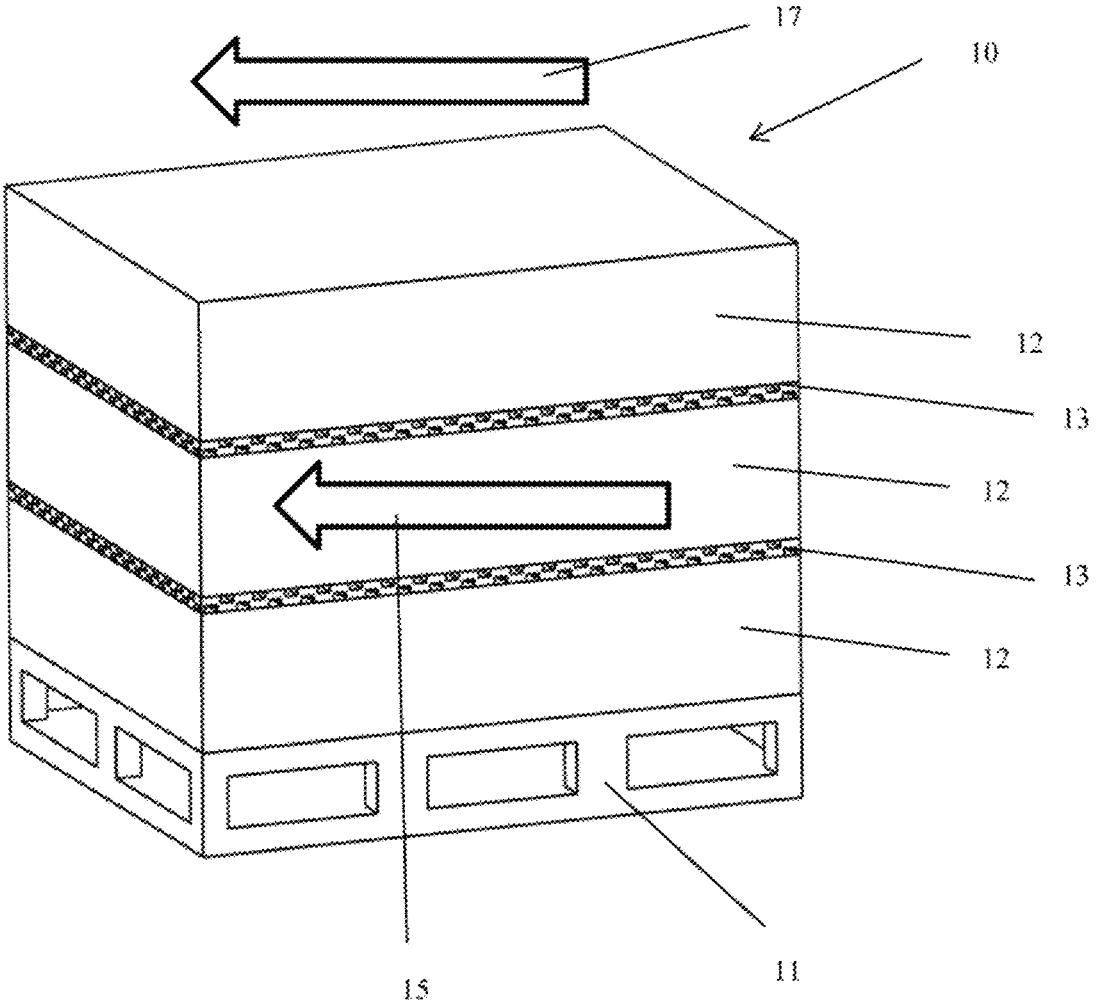
Fig. 1 (Prior Art)
FIG. 1 illustrates a palletized product with horizontal ventilating spacers permitting air flow between adjacent layers of product as is known in the art.

For the purposes of promoting an understanding of certain principles of the claimed inventions, reference will now be made to the embodiments illustrated in the drawings and specific language will be used to describe the same. It will nevertheless be understood that no limitation of the scope of the claims is thereby intended, and alterations and modifications in the illustrated device, and further applications of the principles of the inventions are herein contemplated as would normally occur to one skilled in the art. While the embodiments described below, for example, relate to blast freezing of various products (e.g., fruits, vegetables, meat, seafood, baked goods, etc.) for purposes of illustration, it will be appreciated that the principles of the present description are equally applicable to the blast freezing of any article, and are further applicable to other thermal processing operations driven by airflow, such as cooling, thawing, or warming.

Figure 2:
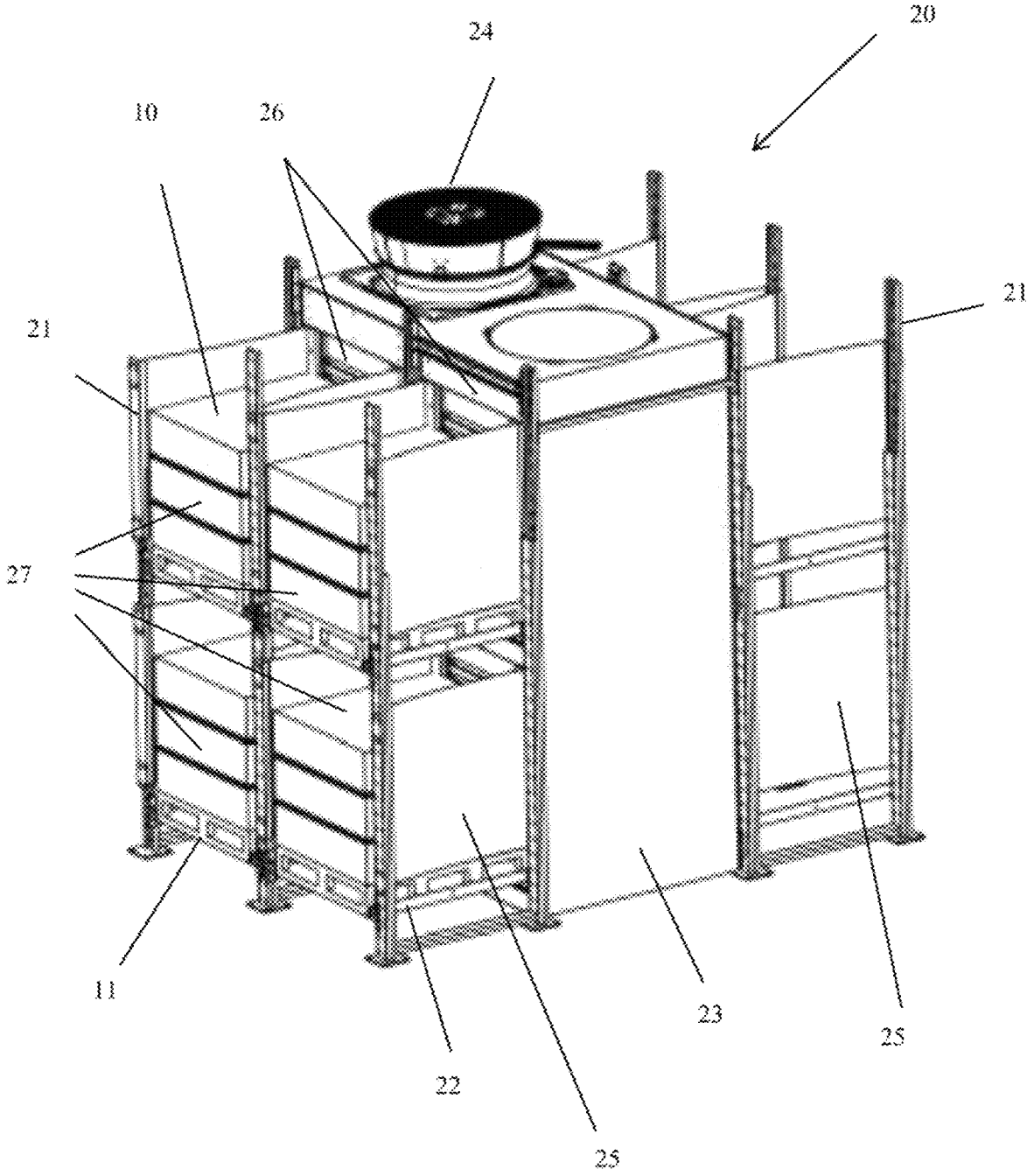
FIG. 2 illustrates a unique pallet rack assembly incorporating a variable louvered door.
Figure 3:
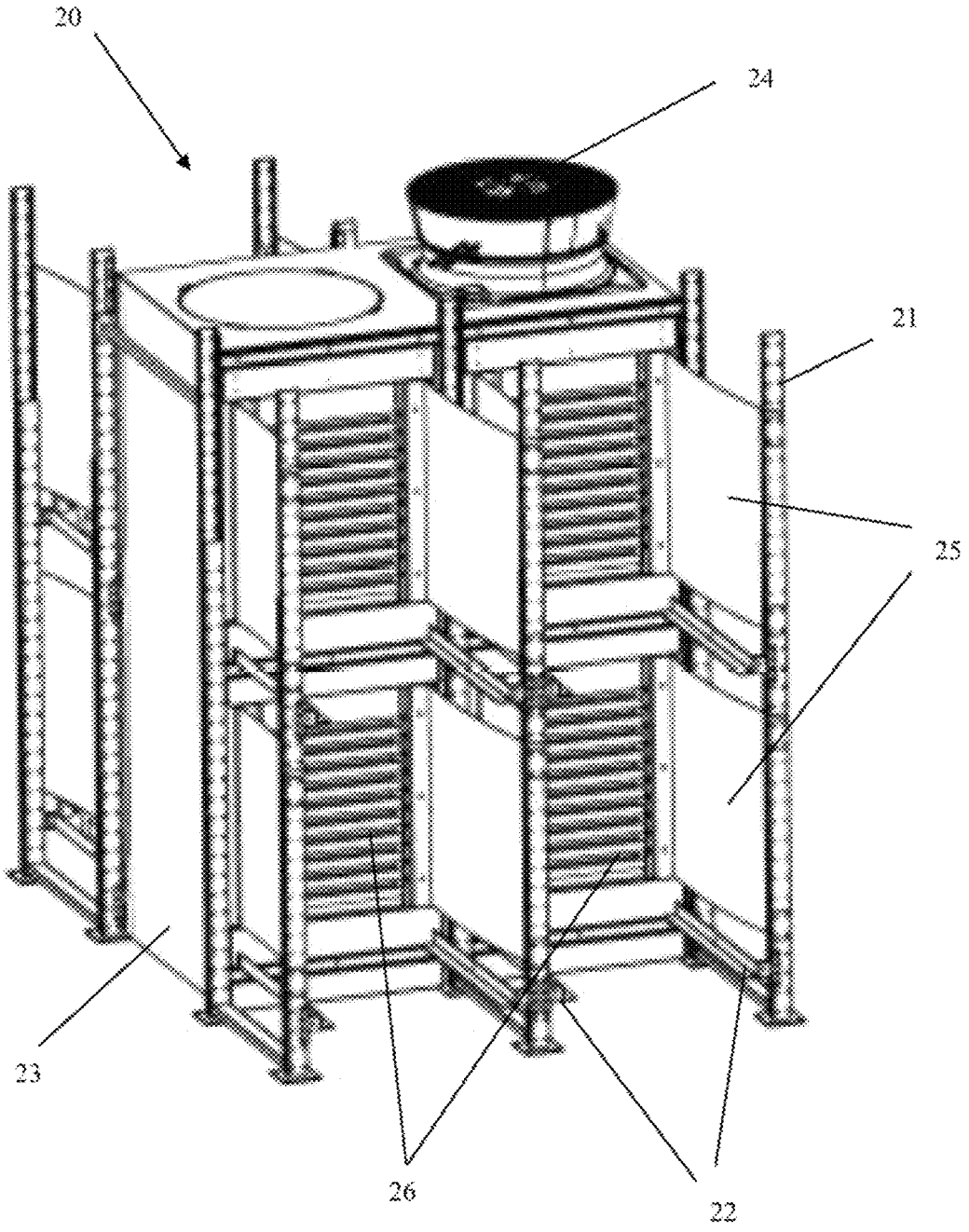
FIG. 3 illustrates an alternate view of the assembly of FIG. 2 showing closed doors in the empty pallet racks.

FIG. 2 illustrates a unique pallet rack assembly incorporating a variable-louvered door. In FIG. 2, blast system 20 has pallet racks 21 which may contain an array of pallet seats 27 configured to received palletized products 10 supported by pallets 11. As shown in FIGS. 2 and 3, the system includes two single-depth pallet racks 21, each with two columns and two rows of pallet seats 27. However, it is understood that different array configurations are compatible with the disclosure herein. Preferably, pallet racks 21 are single-depth pallet racks and system 20 has pallet racks 21 having arrays containing about one (1) to about forty (40) pallet seats 27. Pallet racks 21 may be separated by a plenum which can be sealed on opposing ends by panels 23. Fan 24 may be installed on top of the plenum to draw airflow through the palletized products 10, through variable louvered doors 26 and into the plenum and expel air out the top of the system 20. Fan 24 may be any fixed or variable speed fan compatible with the airflow volumes needed to drive blast system 20 as known to those of skill in the art, preferably driven by an electric motor. Preferably, fan 24 may include a direct drive electronically commutated motor. Such a fan may be modulated between higher and lower airflow settings creating agitation that improves thermal transfer. The top of the rack assembly may be equipped with additional air handling and/or environment equipment. While FIG. 2 shows a single fan 24 in place for the system 20, it is understood that use of additional fans is consistent with the disclosures herein. In a preferred embodiment, pallet racks 21 may include additional flexible side seals 25 which adapt to the side profile of the given product 10 and prevent excess airflow around the palletized goods, as explained further below. Pallet racks 21 may include pallet guide 22 which is configured to align palletized products 10 with the pallet seat 27 to enhance airflow through the product and improve system efficiency.

FIG. 3 illustrates an alternate view of the assembly of FIG. 2 showing closed doors 26 in the empty pallet racks. Pallet rack 21 is shown without any pallets or palletized products in the pallet seats. Side seals 25 have an arcuate profile that narrows toward the plenum side of the pallet rack 21. Each pallet seat is equipped with a variable louvered door assembly 26 and pallet guide 22 for aligning a palletized product with the louvered door 26, both detailed further below. The quick blast systems 20 of FIGS. 2-3 may be used in combination with other features of a thermal processing facility. For example, embodiments may include one or more additional pallet racks for storage separated from the plenum and air handling equipment, which may be arranged in aisles and serviced by fork lifts trucks in a warehouse facility. The concentrated airflows provided by the disclosures herein provide rapid thermal adjustment of the palletized product. Upon reaching the desired temperatures, palletized products can be transferred to storage racks and then different inventory units can be processed by the quick blast system 20.

Figure 4:
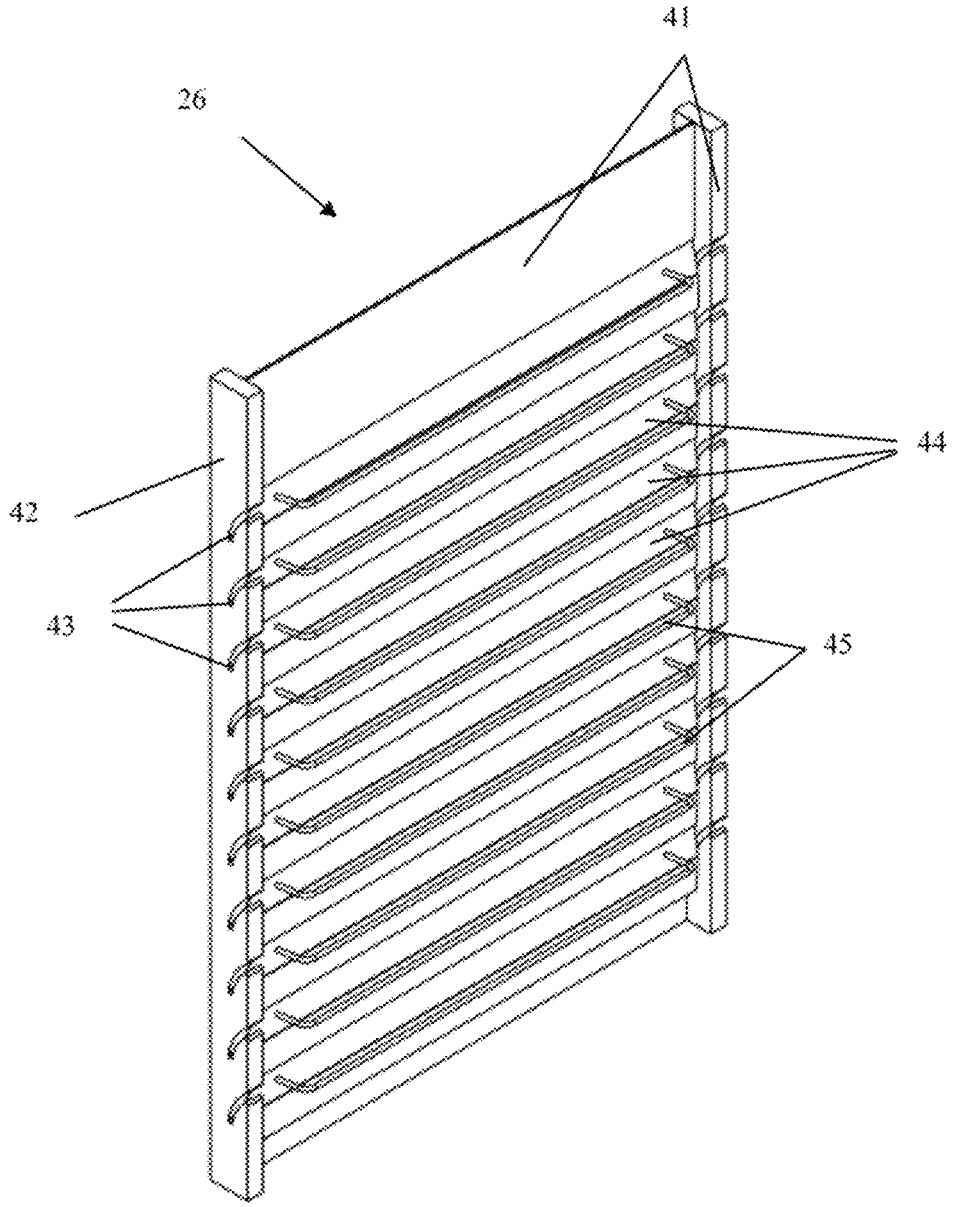
FIG. 4 illustrates a perspective view of the variable louvered door panel included in FIG. 3.

FIG. 4 is a perspective view of an inventive door panel 26 included in FIGS. 2-3. A frame 41 surrounds an opening which, when installed in pallet rack assemblies as seen for example in FIGS. 2-3, is in between a pallet seat and the plenum. The frame 41 includes uprights 42 which are configured with one or more engagement points 43. The engagement points receive pivoting elements of louvers 44. In FIG. 4, there are ten louvers and ten engagement points on each upright, but it is understood that either a larger number or a smaller number of louvers may be used in connection with the inventions claimed herein. Each louver 44 is equipped with a lever arm 45 which may bias the louvers to a closed position. For example, lever arms 45 may be weighted relative to the rest of the louver 44 such that pressure or force applied to the lever arm is needed to rotate the louver 44 to an open position. The preferred arrangements include louvers 44 oriented to span horizontal sections of the opening between the pallet seat and the plenum. Embodiments of the disclosure includes door panel assemblies which include additional mounting hardware suitable for retrofit installation into existing thermal processing facilities and pallet racks.

Figure 5:
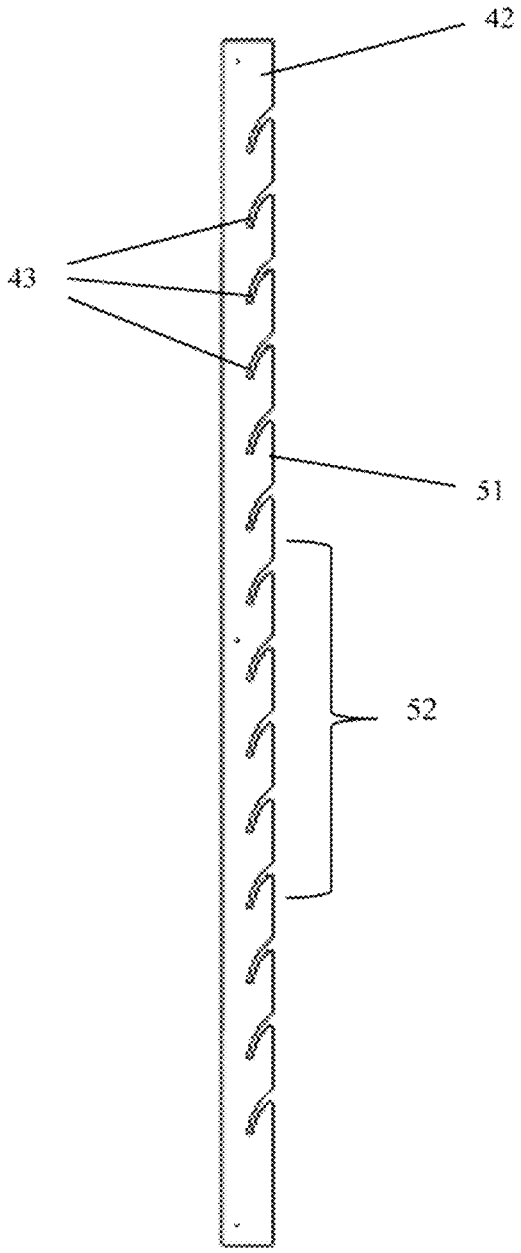
FIG. 5 illustrates a side view of a portion of the frame seen in FIG. 4.

FIG. 5 is a side view of upright 42 of FIG. 4, showing engagement points 43 and an edge 51. Edge 51 may have a sawtooth pattern or profile 52 defining the engagement points 43. Although one form of sawtooth pattern is shown in FIG. 5, it is understood that other edge profiles are compatible with the disclosures herein. When installed, edge 51 is preferably oriented facing into the pallet seat (away from the plenum), such that the engagement points are accessible from the outside of the rack structure and blast system. This allows for easy access and installation, removal, replacement, or repair of louvers or louver door assemblies. For example, louver pivots (shown more clearly in FIGS. 6A-6C) can be set in or lifted out of engagement points 43 through the sawtooth pattern 52 without the use of tools or special equipment. In alternative embodiments (not shown), engagement points 43 may comprise holes, bushings, bearings, sockets, brackets, or any other receiver member suitable for receiving the pivoting louvers as described herein.

Figure 6A:
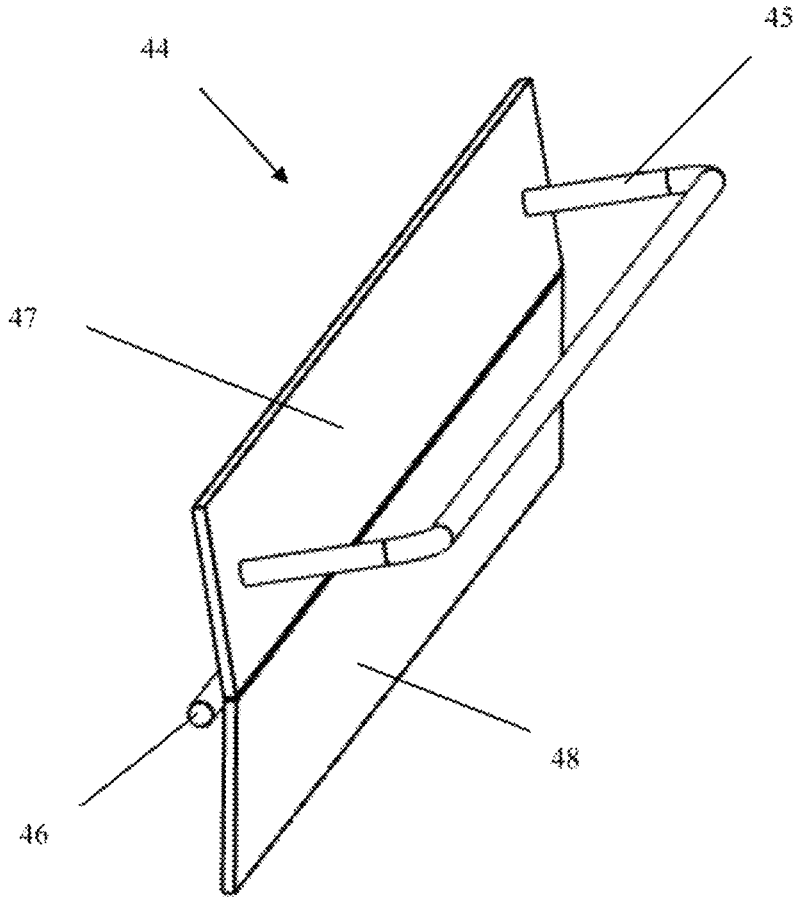
FIGS. 6A-6C illustrate features of the louvers seen in FIGS. 2-4.

FIG. 6A is a perspective view of a louver compatible with the doors 26 of FIGS. 2-4. Louver 44 includes plates 47 and 48 which may be referred to as upper plate 47 and lower plate 48 relative to the orientation of the louver when installed in doors seen in FIGS. 2-4. Louver 44 includes pivot 46 associated with plates 47, 48. Preferably, lever arm 45 is weighted relative to plates 47, 48 such that the center of mass tends to rotate the louver 44 about pivot 46 toward the lever arm 45. When installed, upper plate 47 of one louver may rest against the lower plate 48 of an adjacent louver to establish a closed position wherein air flow is restricted or diminished. (In the uppermost louver, the upper plate 47 may rest against a portion of the frame 41 in the closed position. Similarly, the lower plate 48 of the lowermost louver may rest against a lower section of frame 41 in the closed position, rather than another louver.) This has the effect of closing off the pallet seat from the plenum in the horizontal areas of the opening spanned by each louver. In FIG. 6A, lever arm 45 is shown as a generally cylindrical tube or rail which projects from one end of upper plate 47, bends to extend along the length of upper plate 47, and then bends to return to attach to the other end of upper plate 47. However, other forms of lever arms are compatible with the disclosure, for example, one or more bars, tubes, plates, rods, or other structures may extend from the louver plates at a position suitable to bias the louver to a closed position. When the lever arm 45 is pressed, the louver may rotate the plates 47, 48 relative to the pivot such that the upper plate 47 is no longer resting against plates of the adjacent louver, establishing an open position where air flow is unimpeded. This is shown and discussed further in connection with FIG. 7, below.

Figure 6B:
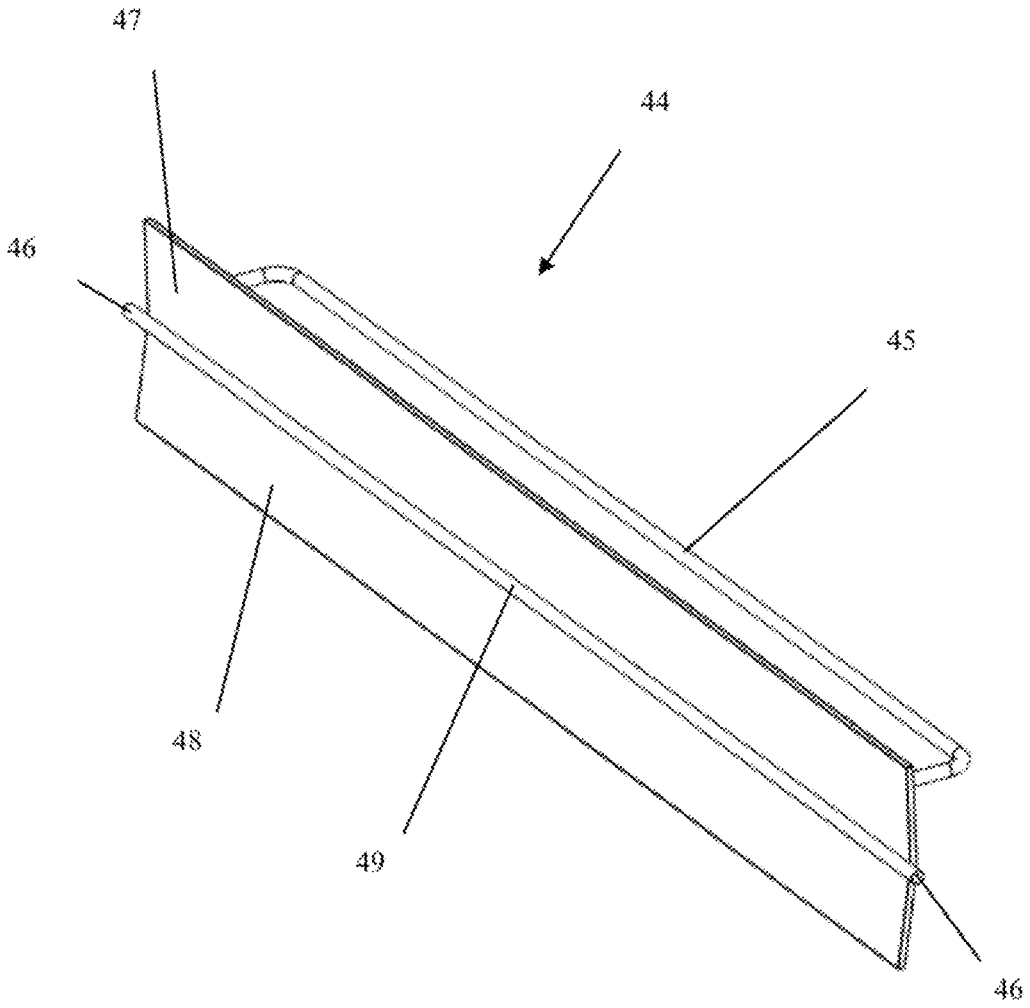
Figure 6C:
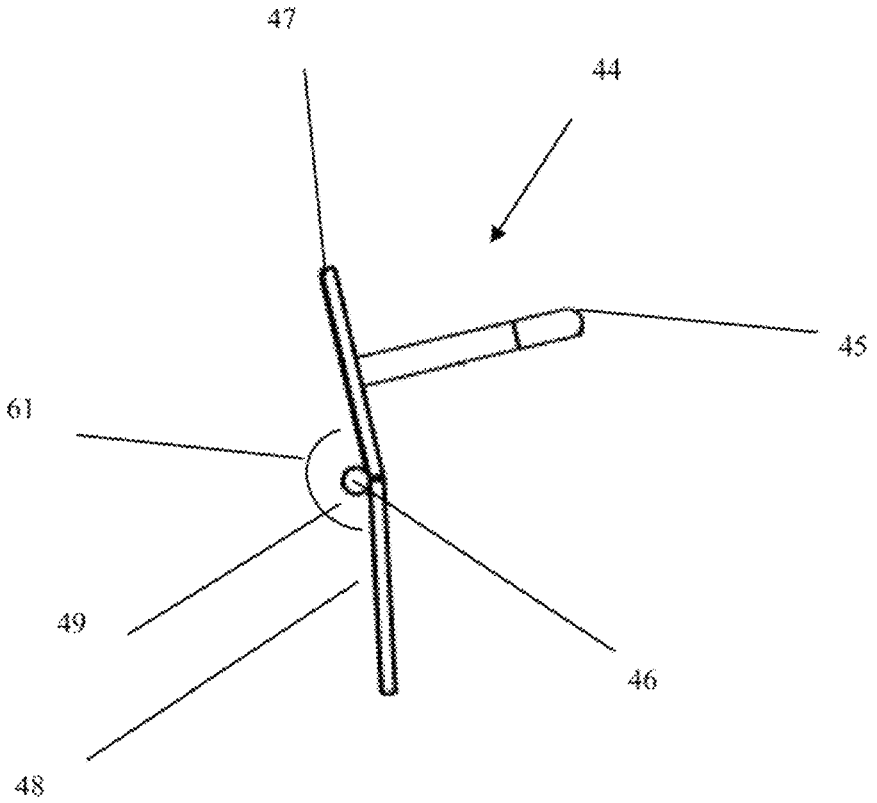

FIG. 6B is a rotated perspective view of the louver of FIG. 6A. As seen in FIG. 6B, pivots 46 may be formed from the ends of rod 49 which extends along the length of louver 44. However, other pivot elements such as pins or axles fixed to the ends of the louver 44 are also compatible with the inventions provided by the disclosure. FIG. 6C is an end view of the louver 44 of FIGS. 6A-6B. As seen in FIG. 6C, preferably, the angle 61 formed by upper plate 47 and lower plate 48 may be obtuse, however, other configurations are possible. In some embodiments, louver 44 may comprise one plate with an upper section and a lower section. Similarly upper plate 47 and lower plate 48 may be oriented at a straight angle (1800). Orienting the plates 47, 48 at an obtuse angle 61 may facilitate the selective, variable opening of individual louvers 44 as disclosed herein.

Figure 7A:
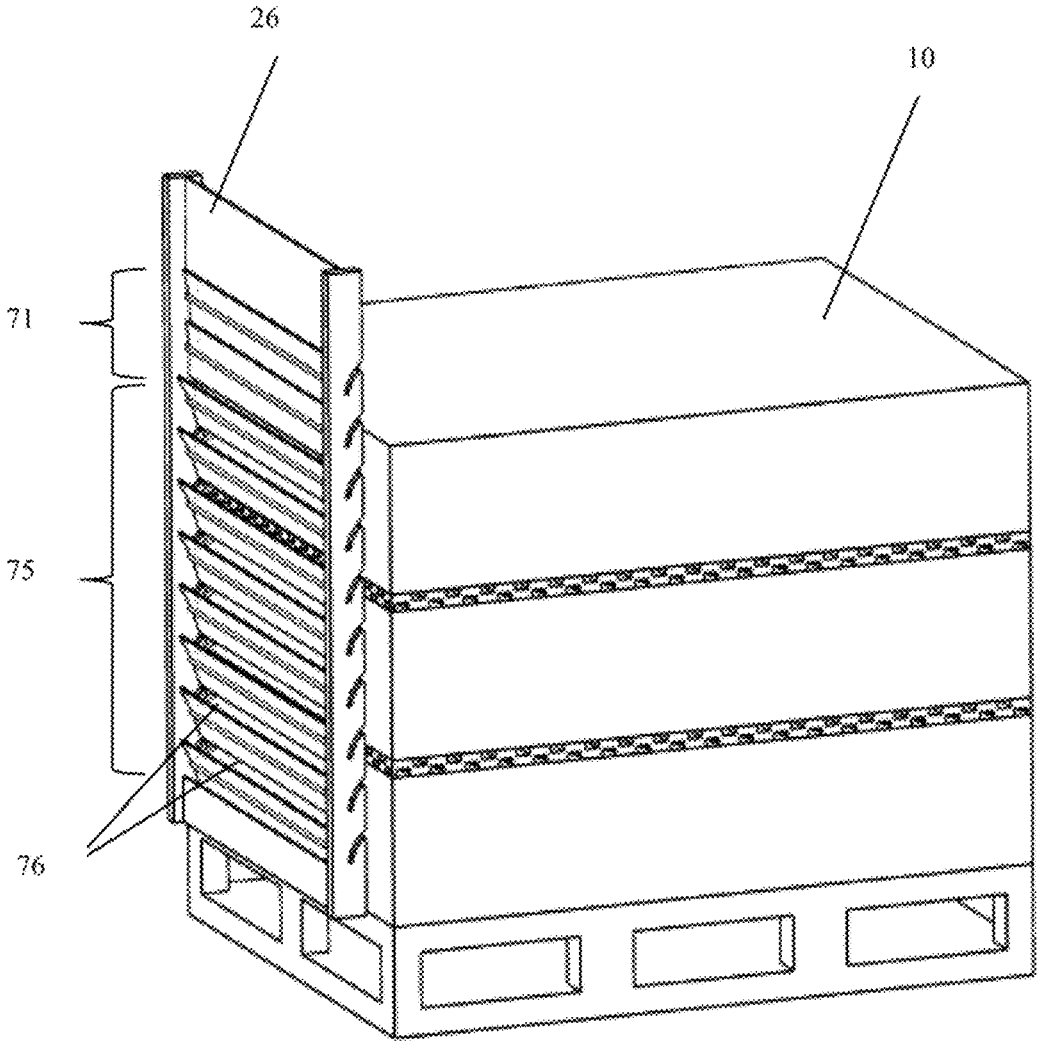
FIGS. 7A-7C illustrates the assembly of FIGS. 4-5 in contact with a palletized product, showing a variable-sized opening to correspond to the height of the palletized product.
Figure 7B:
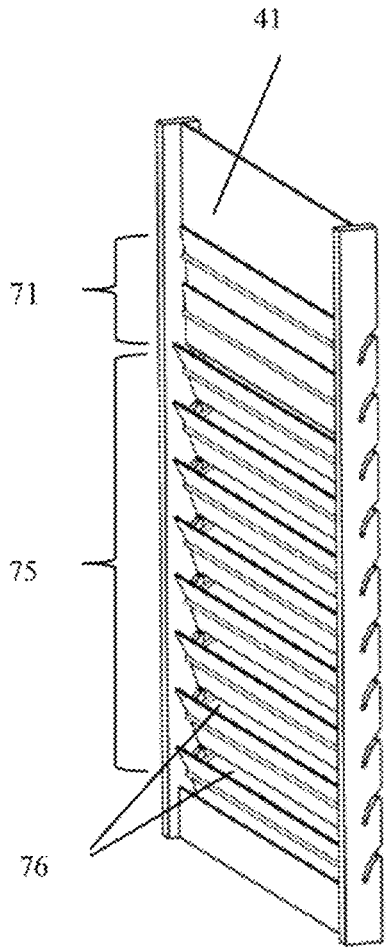
Figure 7C:
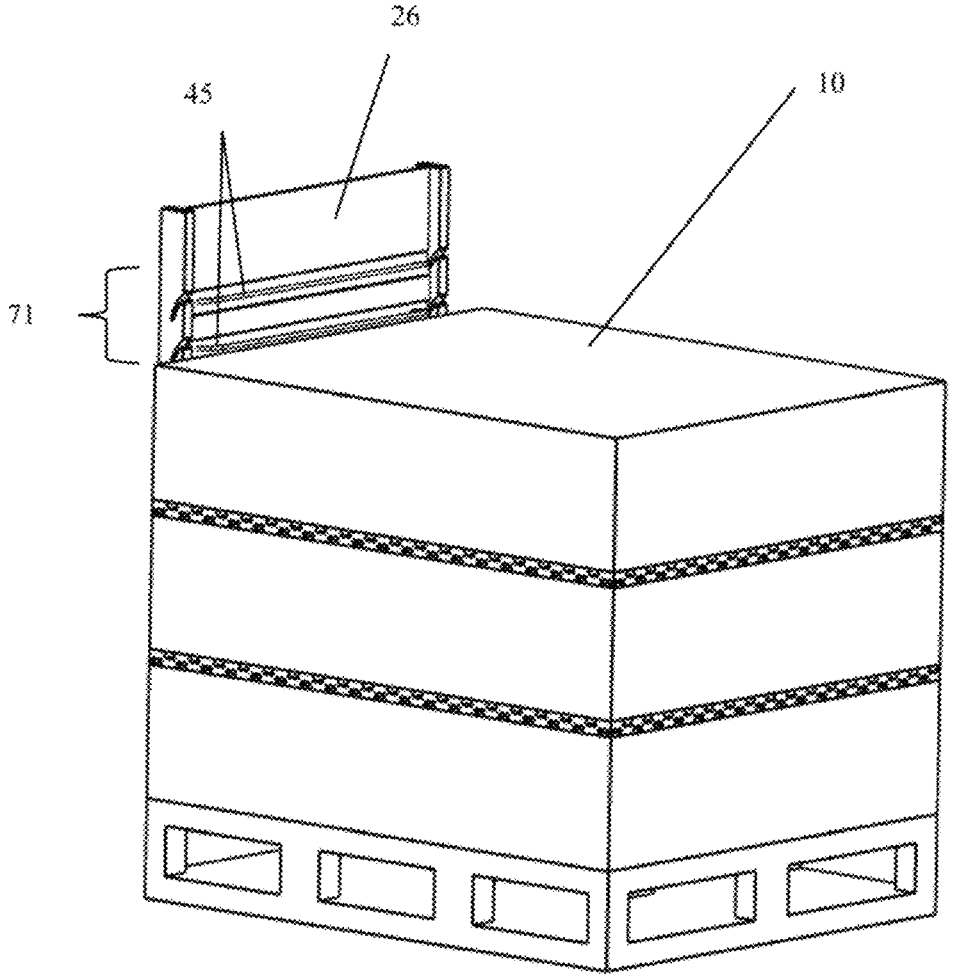

FIGS. 7A-7C show a palletized product in contact with louvered door assemblies of FIGS. 2-6. In FIG. 7A, palletized product 10 is placed against louvered door 26. Upper louvers 71 are not contacted by the palletized product 10 and remain in the closed position. Lower louvers 75 are contacted by the palletized product 10 and rotated to the open position, exposing horizontal openings 76 which improve airflow through the product 10. FIG. 7B is a view of FIG. 7A with the palletized product hidden so that the openings 76 are more clearly visible in the drawing. FIG. 7C is a rotated view of FIG. 7A showing that lever arms 45 of the upper louvers 71 are not contacted by the palletized product. As the louvers are biased to the closed position, the assembly shown can automatically adapt to any height of palletized product 10 which is placed into contact with the variable louvered door 26. Thus, each of the louvers are rotatable about their respective pivots independent of the rotation of the other louvers. By restricting airflow from going around the product 10 in the areas of the closed upper louvers 71, more airflow is driven through the product 10 in the areas of the open louvers 75, providing for more efficient thermal treatment of the product 10. As seen in FIG. 7A-7B, open louvers 75 may be oriented to direct airflow at an upward angle into the plenum and toward fans and air handling equipment (shown in FIGS. 2-3). Thus, louvers in the open position act as turning vanes to reduce turbulence and more efficiently circulate air through the thermal processing system, thereby reducing utility consumption.

Although the drawings generally show the louvers 44 in identical or substantially similar configurations, the louvers may have different properties to enhance operations in particular usage situations or installations. For example, one or more louvers may be configured to overcome the weight of the lever arm to rotate to the open position upon application of sufficient negative pressure from the plenum behind the door panel. Thus, the louver door may act as an overpressure device protecting the air handling equipment from excess strain if an insufficient number of pallets are installed to permit airflow.

Figure 8:
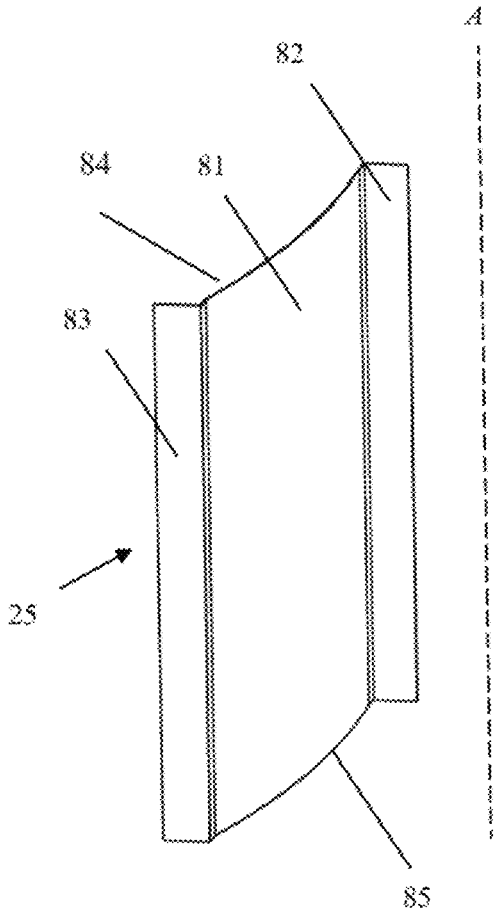
FIG. 8 illustrates a flexible side seal included in FIGS. 2-3.

FIG. 8 shows a flexible side seal 25 first shown above in connection with FIGS. 2-3. The view in FIG. 8 is from the perspective of the front of the pallet rack and shows a left side seal 25, although the parts can simply be mirrored about a vertical axis A to provide a corresponding right side seal. Seal 25 includes a sheet 81, back panel 82, and front panel 83. Back panel 82 may be affixed to the louver door frame or adjacent structures of the pallet rack surrounding the opening into the plenum. Preferably, as shown more clearly in FIG. 10A, back panel 81 is attached to the a portion of the pallet rack enclosing the plenum space while still permitting access to the uprights and sawtooth openings of the door frame to provide enhanced accessibility to the louver assemblies as described above. Similarly, front panel may be affixed to a front portion of the pallet rack assemblies. Top edge 84 and bottom edge 85 are curved such that back panels 82 of a pair of left and right seals are closer together than front panels 83 of the pair of seals. This directs airflow through adjacent palletized products (not shown) rather than permitting airflow around the product and through the louver door. Sheet 81 may be substantially perpendicular to the horizontal door openings. Preferably, sheet 81 is flexible and deforms under air pressure to conform to the shape of adjacent palletized product. This tight seal forces maximum airflow through the palletized goods, particularly in combination with the variable height doors discussed herein.

Figure 9:
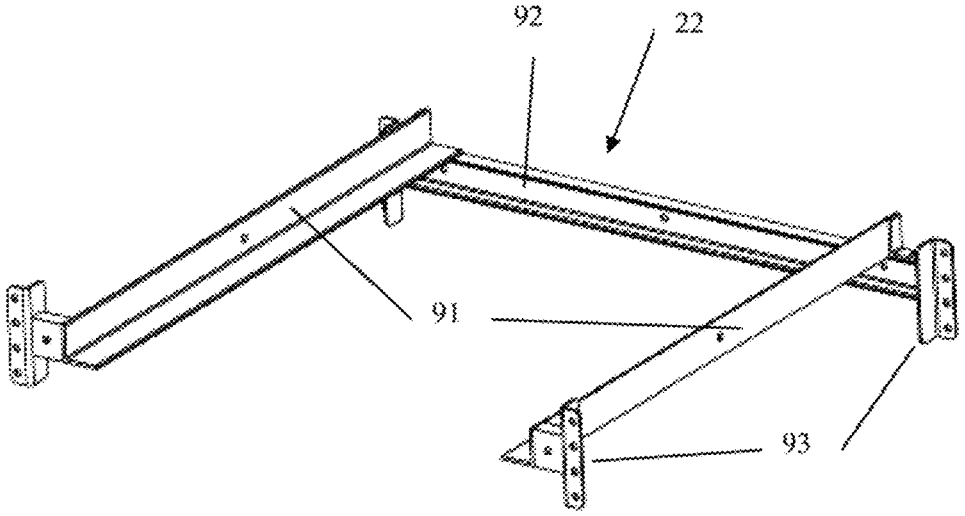
FIG. 9 illustrates a pallet guide previously included in FIGS. 2-3.

FIG. 9 illustrates pallet guide 22 previously described in connection with FIGS. 2-3 above which border pallet seats 27 (see FIGS. 2-3). In FIG. 9, pallet guide 22 includes side rails 91, back rail 92, and mounting hardware 93 for attaching the guide 22 to pallet racks. Preferably, pallet guide 22 does not include components on the side of the pallet seat opposite the plenum, thereby providing one open side for access to the pallet seat. This reduces potential for collisions and errors in pallet loading and unloading and provides greater flexibility in system configuration and usage. Pallet guides 22 may be installed in pallet racks to align palletized products with the plenum openings and louvered doors discussed above. Careful alignment, variable-height door openings, and flexible side seals all contribute to increased airflow through the palletized product and improved thermal transfer and system efficiencies.

Figure 10A:
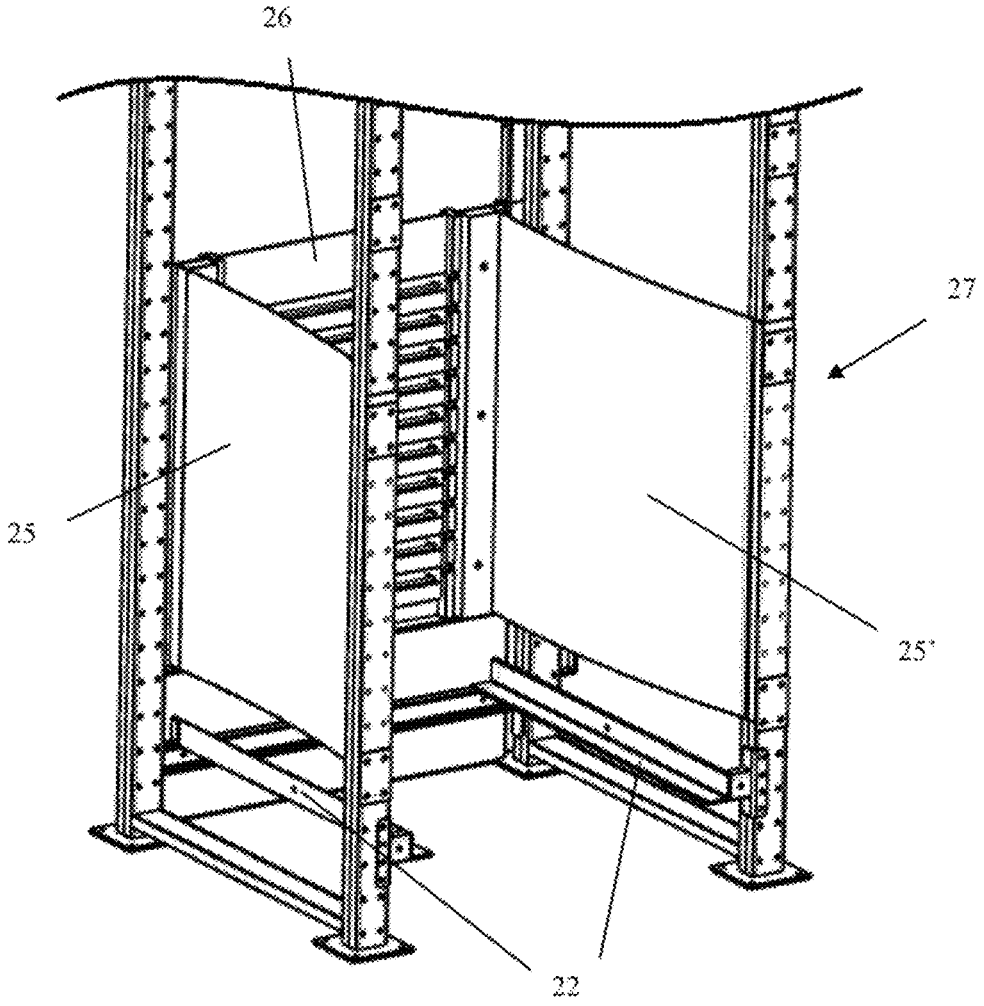
FIGS. 10A-10B illustrate a partial pallet rack assembly of FIGS. 2-3 including the components shown in FIGS. 4-9 in more detail.
Figure 10B:
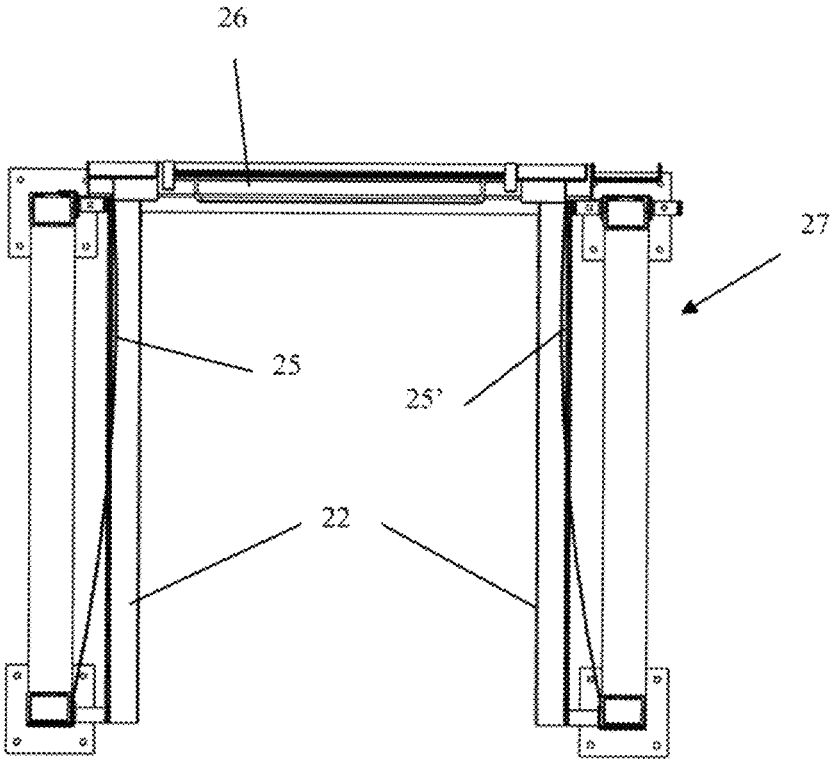

FIGS. 10A-10B illustrate a partial pallet rack assembly of FIGS. 2-3 showing the above-described components of FIGS. 4-9 in combination and more detail as a single pallet seat 27. FIG. 10A is a perspective view showing pallet seat 27 bounded by variable louvered door 26, flexible left side seal 25, flexible right side seal 25', and pallet guide 22. As seen in FIGS. 2-3, pallet seats 27 may be arrayed in multiple rows and columns adjacent to a plenum and related air handling equipment and fans. Palletized products may typically be provided on standard heights of pallets such that pallet guides 22 can be in a fixed height relative to plenum opening provided by door panel 26. However, pallet guides 22 may be provided at differing heights or adjusted to accommodate different sized pallets as needed. Thus, the bottom edge of containers 12 (see FIG. 1) may be aligned with the bottom of door 26 when seat 27 is filled with a palletized product. FIG. 10B is a top view of the pallet seat 27 of FIG. 10A. As seen in FIG. 10B, curved sheets of seals 25 and 25' may extend inward of the rails of pallet guide 22, ensuring a tight fit when palletized products are loaded into seat 27. Upon application of airflow, side seals 25 and 25' will seal against the side of the containers, and airflow above the palletized product containers will be obstructed by the closed louvers of the door 26 and/or surrounding framing components. Such combinations provide enhanced airflow through the palletized products and increase thermal transfer and system efficiency.

The invention claimed is:

1. A panel for a pallet rack assembly in a thermal processing facility, comprising:

a plurality of louvers, wherein each louver comprises a pivot associated with a plate and a lever arm extending from the plate; and a frame surrounding an opening, the frame comprising a plurality of engagement points receiving the pivots of each of the louvers, wherein the louver plates are oriented to span horizontal sections of the opening;

wherein the lever arms are weighted to bias the louvers to a closed position inhibiting airflow through the opening near the horizontal sections spanned by the louver plates;

wherein the lever arms are pressable to rotate the louver plates about their respective pivots to an open position allowing airflow through the opening near the horizontal sections spanned by the louver plates; and wherein a first louver from the plurality of louvers is rotatable about its respective pivot independent of the rotation of a second louver from the plurality of louvers, wherein the first louver is adjacent to the second louver;

wherein the louver plates comprise an upper section at an obtuse angle to a lower section, wherein the lever arms extend from the upper section of each louver.

2. The panel of claim 1, wherein each of the plurality of louvers are rotatable about their respective pivots independent of the rotation of all of the other louvers.

3. The panel of claim 2, in combination with a flexible side sheet oriented substantially perpendicular to the horizontal sections of the opening, wherein, upon introduction of airflow toward the panel, the side sheet is adapted to conform to a shape corresponding to the vertical profile of a pallet of goods.

4. The panel of claim 2, wherein louvers in the open position act as turning vanes directing airflow toward a fan.

5. The panel of claim 4, wherein, in the closed position, the lower section of the plate of an upper louver rests against the upper section of the plate of an adjacent lower louver.

6. The panel of claim 1, wherein the frame comprises an upright with sawtooth openings comprising the engagement points.

7. The panel of claim 1, wherein at least one louver is configured to overcome the weight of the lever arm and rotate to the open position upon application of sufficient negative pressure from a plenum behind the panel.

8. The panel of claim 1, in combination with guide rails spaced to receive and support a pallet and align the pallet with the panel.

9. A pallet rack for a thermal processing facility, comprising:

an array of pallet seats adjacent to a plenum;

a frame in between at least one pallet seat and the plenum, the frame surrounding an opening to the plenum having an upper section and a lower section, the frame comprising an engagement point receiving a louver comprising a pivot associated with a plate, the pivot being inserted into the engagement point, wherein the louver plate is oriented to span the upper section of the opening; and a flexible side sheet connected to the frame and oriented substantially perpendicular to the frame, wherein, upon introduction of airflow toward the frame, the side sheet is adapted to conform to a shape corresponding to the vertical profile of a pallet of goods;

wherein the louver is biased to a closed position inhibiting airflow through the upper section of the opening by a bar attached to the plate;

wherein the plate comprises a first section at an obtuse angle to a second section, wherein the bar extends from the first section, wherein in the open position the louver directs airflow into the plenum at an upward angle;

wherein, when the bar is pushed, the louver plate is rotatable about the pivot to an open position allowing airflow through the upper section of the opening.

10. The pallet rack of claim 9, further comprising a second louver comprising a second pivot associated with a second plate; wherein the second louver plate is oriented to span the lower section of the opening; wherein the second louver is biased to a closed position inhibiting airflow through the lower section of the opening; wherein the second louver is rotatable about the second pivot independent of the rotation of the louver about the pivot.

11. The pallet rack of claim 9, wherein the frame comprises an upright with sawtooth openings comprising the engagement point.

12. The pallet rack of claim 9, wherein the at least one pallet seat comprises guide rails spaced to receive and support a pallet and align the pallet with the frame.

13. A blast freezer system for a thermal processing facility, comprising:

a pallet rack assembly comprising an array of pallet seats adjacent to a plenum, the pallet rack assembly having a depth corresponding to the thickness of a single pallet to facilitate freezing of products on the pallet;

an air handler positioned at the top of the plenum operating to draw freezing air through the pallet seats into the plenum;

a frame separating at least one pallet seat from the plenum, the frame surrounding an opening to the plenum and comprising a plurality of engagement points for receiving a set of louvers, wherein each louver comprises a pivot associated with a plate, the pivots being positioned in the engagement points of the frame;

wherein the louver plates are oriented to span horizontal sections of the opening;

wherein the louvers are biased to a closed position inhibiting airflow through the opening near the horizontal sections spanned by the louver plates and wherein the louver plates comprise a first section at an obtuse angle to a second section, wherein a bar extends from the first section;

wherein the louvers are pressable by pressing the bar to rotate the louver plates about their respective pivots to an open position allowing airflow through the opening near the horizontal sections spanned by the louver plates;

wherein each of the louvers are rotatable about their respective pivots independent of the rotation of the other louvers such that a pallet carrying palletized goods pressed against the louvers only exposes the opening to a height corresponding to the height of the palletized goods, thereby directing airflow through the palletized goods and into the plenum.

14. The blast freezer system of claim 13, wherein the at least one pallet seat comprises flexible side sheets oriented substantially perpendicular to the frame, wherein, upon introduction of airflow toward the frame, the side sheets are adapted to conform to a shape corresponding to the vertical side profiles of a pallet of goods, thereby sealing the sides of the pallet of goods to direct airflow through the palletized goods.

15. The blast freezer system of claim 14, wherein the at least one pallet seat comprises guide rails spaced to receive and support a pallet and align the pallet with the frame.

16. The blast freezer system of claim 15, comprising pallets of palletized products placed in the pallet seats, wherein the pallets occupy less than all of the array of pallet seats.

17. The blast freezer system of claim 13, wherein the air handler comprises a fan with a direct drive electronically commutated motor.

18. The blast freezer system of claim 13, in combination with a second pallet rack separated from the plenum, the second pallet rack comprising a second array of pallet seats for storage of palletized products.

* * * * *